US005505383A

United States Patent [19]

Fischer

[11] Patent Number: 5,505,383

[45] Date of Patent: Apr. 9, 1996

[54] FIRE PROTECTION NOZZLE

[75] Inventor: Michael A. Fischer, West Kingston, R.I.

[73] Assignee: Grinnell Corporation, Cranston, R.I.

[21] Appl. No.: 333,523

[22] Filed: Nov. 2, 1994

[51] Int. Cl.[6] ..... A62C 31/02

[52] U.S. Cl. ..... 239/518; 169/37

[58] Field of Search ..... 239/518, 524, 239/512, 506, 515; 169/37–41, 90

[56] References Cited

U.S. PATENT DOCUMENTS

| | | | |
|---|---|---|---|
| 498,661 | 5/1893 | Kersteter . | |
| 570,721 | 11/1896 | Tilden | 169/37 |
| 891,278 | 6/1908 | Martin . | |
| 1,246,355 | 11/1917 | Thomas | 169/37 |
| 1,719,371 | 7/1929 | Holt et al. | 169/40 |
| 1,876,669 | 9/1932 | Harlow | 239/524 |
| 2,687,180 | 8/1954 | Cranston . | |
| 2,884,206 | 4/1959 | Dukes | 169/37 |
| 3,051,397 | 8/1962 | Hanson . | |
| 3,249,309 | 5/1966 | Blackhall | 239/518 |
| 3,459,266 | 8/1969 | Ault | 169/41 |
| 3,756,321 | 9/1973 | Gloeckler | 169/40 |
| 3,872,928 | 3/1975 | Livingston | 169/37 |
| 4,465,141 | 8/1984 | Johnson . | |
| 4,585,069 | 4/1986 | Whitaker . | |
| 4,596,289 | 6/1986 | Johnson | 169/37 |
| 4,932,591 | 6/1990 | Cruz | 239/518 |

OTHER PUBLICATIONS

"Fire Test Status Report on the Evaluation of the Aquamist™ . . . Machinery Spaces"; by Jerome S. Pepi, Grinnell Cororation; Prepared for Society of Fire Protection . . . Halon Alternatives; Univ. of Tennessee Conference Center; Knoxville, TN; pp. 1–18; Jun. 28, 1994.

*Primary Examiner*—Karen B. Merritt
*Attorney, Agent, or Firm*—Fish & Richardson

[57] ABSTRACT

A fire protection nozzle has a base, an orifice, defined by the base and having a predetermined diameter, through which fire-retardant fluid can flow, a inlet section having an upstream end and defining a conduit for flow of the fire-retardant fluid along a conduit axis and leading to an upstream end of the orifice, a diffuser element positioned coaxially with and downstream of the orifice, and one or more arms extending from the base and supporting the diffuser element in a position, where, when flow of the fire-retardant fluid from the inlet section through the orifice is established, the fire-retardant fluid emerges from the orifice in a stream which impinges on a diffuser surface defined by the diffuser element to be distributed in a spray pattern. The diffuser surface defined by the diffuser element is generally spherical in shape in a region extending from an upstream end closest to the orifice to at least downstream of an equatorial plane of the diffuser element transverse to the conduit axis.

13 Claims, 3 Drawing Sheets

FIRE PROTECTION NOZZLE

FIELD OF THE INVENTION

This invention relates to manually and automatically operated nozzle systems for discharging fire-retardant fluids.

BACKGROUND OF THE INVENTION

Certain types of fire protection nozzles are used to discharge water, with or without additives, in a relatively fine spray, which is generally referred to in the industry as mist.

The mechanism by which a fine spray (water mist) nozzle system acts to control, suppress or extinguish a fire can be a complex combination of two or more of the following factors, depending on the class(es) of the combustible materials involved, the operating concept of the individual nozzle, the size of the orifice(s), the operating pressure and the flow rate:

(1) Heat extraction from the fire as water is converted into vapor and the fuel is cooled;

(2) Reduced oxygen levels as the water vapor displaces oxygen near the seat of the fire;

(3) Dilution of flammable vapors by the entrainment of water vapor to such an extent that the resultant mixture of vapors will not burn;

(4) Enveloping of the protected area to pre-wet adjacent combustibles, cool gases and other fuels in the area and block the transfer of radiant heat to adjacent combustibles; and/or (5) Direct impingement wetting and cooling of the combustibles.

In the case of Class A combustibles, a combination of factors (1), (2), (4) and/or (5) may be involved, while a combination of factors (1), (2) and/or (3) may be involved in the case of Class B fires. In order to prevent the electrical conductivity of water from representing a potential problem, the extinguishment of Class C fires by fine water mist is generally limited to nozzle systems which primarily depend on factors (1) and/or (2) only.

It is generally acknowledged that in order for water spray to be described as mist-like, the majority of the water droplets should have a diameter of less than 500 microns (0.020 inch).

However, in the case of Class B fires, the majority of the droplets should have a diameter of less than 300 microns (0.012 inch) in order to maximize the effects of factors (1), (2) and/or (3). In the case of Class C fires, the majority of the water droplets should have a diameter less than 200 microns (0.008 inch) in order to maximize the effects of factors (1) and/or (2) at the smallest practical fire size. In the case of Class A fires, the mist-like droplets may be intentionally combined with a small percentage of high momentum large droplets, in the order of up to 1500 microns (0.060 inch), which serve to entrain and drag the mist-like droplets into the combustion zone, as well as provide some direct impingement wetting and cooling of the combustibles.

Various types of nozzles discharging a fine water spray have long been used in fire protection systems. Although often not described as such at the time, perforated diffuser sprinklers, e.g. as described in Parmalee U.S. Pat. No. 6,275, discharged water in a fine spray by nature of the diffuser holes being in the order of 0.06 inch in diameter. Other examples of fine spray nozzle designs intended for use in fire protection system applications are described in Lewis U.S. Pat. No. 2,310,798, which is based on the use of impinging jets to create a "cloud" of spray, as well as Loepsinger U.S. Pat. No. 2,361,144 and Papavergos U.S. Pat. No. 4,989,675, which are based on establishing a gas-water mixture to create an atomized spray. Further techniques for delivering fine spray for fire suppression purposes include: using an array of nozzles originally designed for fine oil mist atomizing, e.g. in oil burner applications, and using nozzles with an internal fixed scroll, or a whirling device, e.g. as described in PCT Publication No. WO 92/20454.

Within the water spray fire protection field, there has been extensive use of hemispherical or spherical surfaces downstream of the nozzle or sprinkler orifice, to act as a first stage splitter or diverter in conjunction with a second stage deflector which distributes the water spray over the area to be protected. In most of these cases, the splitter is utilized to spread out the stream of fluid flow over a greater area, so that a larger deflector can be used to distribute the fluid over the area to be protected. Such an approach allows a wide range of second stage deflector designs to be implemented for control of the distribution of fluid over the area to be protected. Examples of such use with hemispherical splitter surfaces are given in W. Johnson U.S. Pat. No. 4,465,141 and K. Johnson U.S. Pat. No. 4,596,289. A similar principle is involved in Hanson U.S. Pat. No. 3,051,397, although, in this case, a spherical splitter is used to first fan out the fluid stream against the interior of a cylindrical wall for the purpose of agitating the fluid and entraining air drawn in from the inlet, prior to the resultant fluid mixture being distributed by a downstream deflector, over the area to be protected. However, it should be noted that in this patent, Hanson '397 also indicates that a spherical splitter was used for the sake of simplicity and that a hemispherical splitter would have performed the required function.

There has also been extensive use of hemispherical elements in fire protection nozzles and sprinklers as a mounting location for the fluid deflectors at the junction point of structural support arms extending from the nozzle or sprinkler base. However, in cases such as those illustrated in Martin U.S. Pat. No. 891,278 and Whitaker U.S. Pat. No. 4,585,069, the hemispherical design has also been selected to suitably spread the fluid stream being emitted from the nozzle (sprinkler) orifice over the second stage nozzle (sprinkler) deflector, for distribution over the area to be protected. However, it is well known in the art that, because of the diverting effect that even hemispherical surfaces have on the fluid stream being discharged from the nozzle orifice, their use as a first stage splitter results in a relatively hollow cone or zone of light spray in the region to be protected that is downstream of the nozzle and coaxial with the nozzle orifice. The volume of this zone of light spray may be either increased or decreased by the second stage deflector, depending upon its design. Hanson U.S. Pat. No. 3,051,397 teaches the use of a spherical splitter only for the purpose of simplicity, with acknowledgement that the desired diverting of the fluid stream and the fanning out of the spray to the inside wall of an enclosing cylinder could be performed with a hemispherical splitter. In addition, as illustrated, Hanson '397 required a deflector downstream of the splitter to distribute the fluid mixture over the area to be protected and, the central conical region immediately upstream of the deflector resulted in a zone of light spray in the region to be protected downstream of and coaxial with the device. Furthermore, the spherical splitter is described by Hanson '397 as being selected to have a diameter slightly greater than that of the orifice only to ensure that substantially all of the fluid stream would impinge on the splitter, even if the stream expanded somewhat between the nozzle orifice and the splitter.

SUMMARY OF THE INVENTION

This invention concerns a new type of fire protection nozzle, primarily intended for use in Class B fire situations, comprising a diffuser element capable of distributing a relatively high momentum fine spray, with the majority of the water droplets having a diameter of less than 300 microns, as described in "Fire Test Report on the Evaluation of the AquaMist® Fixed Water Mist Deluge System in Ventilated Marine Machinery Spaces" by Jerome S. Pepi (published Jun. 28, 1994). In its preferred embodiment, the diffuser element defines a spherical surface located coaxially with the nozzle orifice and downstream of the orifice, for the purpose of distributing a spray of water mist over the area to be protected, with a relatively filled cone of spray in the region downstream of and coaxial with the nozzle. Also, in its preferred embodiment, the spherical surface of the diffuser element of the invention has an equatorial diameter of at least twice the diameter of the fluid stream being emitted from the nozzle orifice.

Objectives of this invention include to provide an improved fine spray (water mist) fire extinguishing nozzle that is simple, reliable and has a relatively low manufacturing cost. A further objective of this invention is to provide a water mist nozzle that can distribute a relatively filled cone of spray over the area to be protected, with the majority of the water droplets having diameters of less than 300 microns (0.012 inch) at a pressure of about 175 psi. Another objective of this invention is to provide a water mist fire extinguishing nozzle that emits relatively high momentum fine droplets which are capable of projecting distances of 5 meters (16 feet) or more and penetrating the strong updrafts of established hydrocarbon fuel fires as well as being deflected and re-distributed throughout the volume to be protected, even into areas that are somewhat shielded or concealed from the spray discharged directly from the nozzle.

Objectives of this invention also include to provide the above performance characteristics at a relatively low flow rate per nozzle, but not such a low flow rate that requires use of an undesirably small orifice that is excessively susceptible to clogging due to debris in the fluid supply, unless a very fine filter is used to screen the fluid flow to the nozzle orifice.

According to the invention, a fire protection nozzle achieving one or more of these objectives comprises a base, an orifice, defined by the base and having a predetermined diameter, through which fire-retardant fluid can flow, an inlet section having an upstream end and defining a conduit for flow of the fire-retardant fluid along a conduit axis and leading to an upstream end of the orifice, a diffuser element positioned coaxially with and downstream of the orifice, and one or more arms extending from the base and supporting the diffuser element in a position, where, when flow of the fire-retardant fluid from the inlet section through the orifice is established, the fire-retardant fluid emerges from the orifice in a stream which impinges on a diffuser surface defined by the diffuser element to be distributed in a spray pattern. The diffuser surface defined by the diffuser element is generally spherical in shape in a region extending from an upstream end closest to the orifice to at least downstream of an equatorial plane of the diffuser element transverse to the conduit axis.

Preferred embodiments of the invention may include one or more of the following additional features. The diffuser surface of the diffuser element has a diameter of at least two times (preferably two to four times, and more preferably about three times) the predetermined diameter of the orifice. The diameter of the diffuser surface of the diffuser element is between about 0.18 inch and 0.38 inch, and preferably is about 0.28 inch, and more preferably occurs at the equatorial plane. The diameter of the orifice is between about 0.06 inch and 0.12 inch, and preferably is about 0.09 inch. The fire retardant fluid flowing from the orifice has a pressure of 100 psi or above, and preferably about 170 psi or above. The fire protection nozzle further comprises two support arms, and an apex element disposed at a juncture of the arms, generally coaxial with the conduit axis, and the diffuser element is mounted at an end of the apex closest to the orifice, with an area of intersection of the diffuser element and the apex in a plane perpendicular to the conduit axis having a diameter about 65 percent or less of the diameter of the diffuser element at its equatorial plane, whereby a portion of the fire retardant fluid discharging from the orifice remains attached upon the diffuser surface of the diffuser element downstream, past the equatorial plane, thereby, providing a relatively filled cone of fine spray from the nozzle. Preferably, the diffuser element is secured upon the apex by resistance welding.

The nozzle base, arms, apex, diffuser element and orifice (which may or may not be separately fabricated from the base) are manufactured of stainless steel, to provide sufficient resistance to the intense heat which can be associated with direct impingement of the flames from a high pressure hydrocarbon fuel fire as well as, resistance to corrosion which could be caused by salt air or use of sea water as the fire retardant fluid media. The spherical diffuser element is positioned coaxial with the nozzle orifice by two support arms extending from the base, on opposite sides of the orifice and joined together at an apex downstream of the spherical diffuser element so as to minimize the disturbance to the pattern of the mist which is distributed over the area to be protected.

The spherical diffuser element for a fire protection nozzle of the invention thus provides distribution of fire retardant fluid over the area to be protected and, more specifically, provides distribution of a fine spray or mist in a generally conical pattern that is relatively filled with fluid droplets with features as described above. These attributes have been achieved through the discovery that fine droplets become detached from all around the spherical surface of the diffuser element of this invention, including that portion of the spherical surface which is downstream of its equatorial plane, which results in a generally conical spray pattern that is nearly completely filled with fine fluid droplets.

Furthermore, it has been found that at pressures of 100 psi and above and more preferably at pressures of 170 psi and above, the fine fluid droplets which are distributed by the spherical element have the required predetermined projection distance, combined with the relatively high momentum, necessary to penetrate strong upward drafts associated with hydrocarbon fuel fires and the like, due in great part to the streamlined nature of the fluid flow around the spherical surface of the diffuser element of the invention.

To a certain extent, the portions of the nozzle support arms which are located downstream of the spherical diffuser element, in the preferred embodiment of this invention, provide narrow openings in the spray pattern close to the nozzle. However, by utilizing a relatively narrow width along the upstream (inside) edges of the arms, combined with a streamlined shape for the arms in the vicinity of the apex, the disturbance to the spray pattern caused by the arms is minimized and of no substantial consequence, over 0.5 m (1.6 feet) from the nozzle.

Further objectives of the invention include providing a nozzle, e.g., for use as part of a fire extinguishing system, for use in extinguishing Class B fires involving flammable hydrocarbon liquids and gases, for use in extinguishing Class A fires involving ordinary combustible materials such as wood, cloth, paper and plastics, as well as for use in extinguishing Class C fires involving electrical or electronic equipment where consideration of the electrical conductivity of the extinguishing media is of importance.

DESCRIPTION OF THE PRESENTLY PREFERRED EMBODIMENTS

Figure 1:
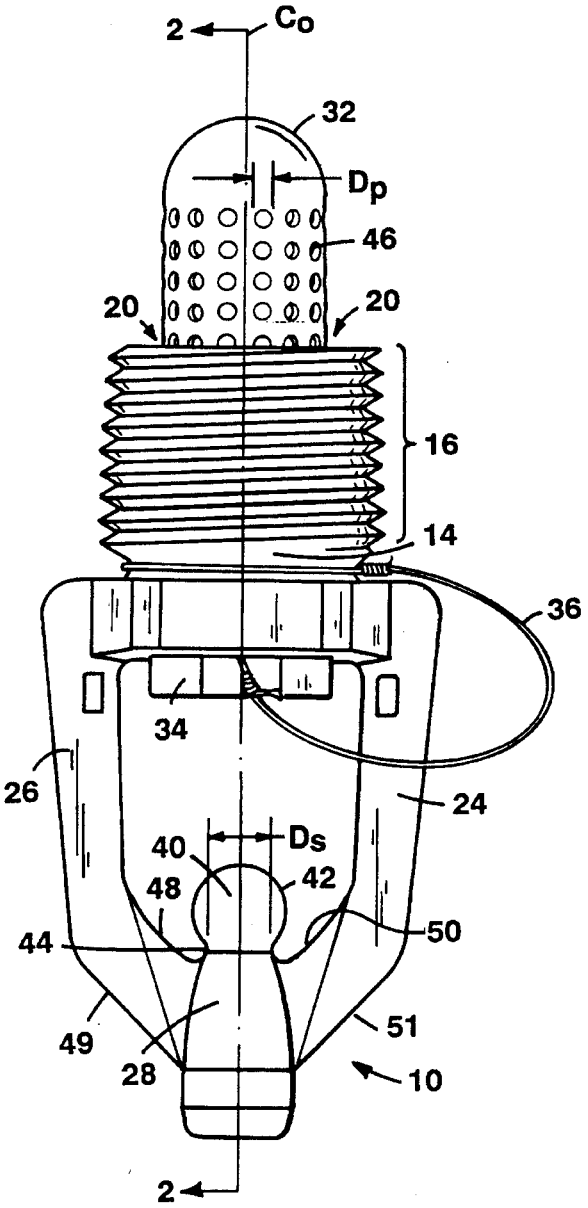
FIG. 1 is a front elevation of a fire protection sprinkler nozzle with a spherical diffuser surface of the invention.

Referring to FIG. 1, a fire protection sprinkler nozzle 10 of the invention has a base 14 defining external threads 16 for threaded sealed connection to a fire retardant fluid supply system (not shown).

Figure 2:
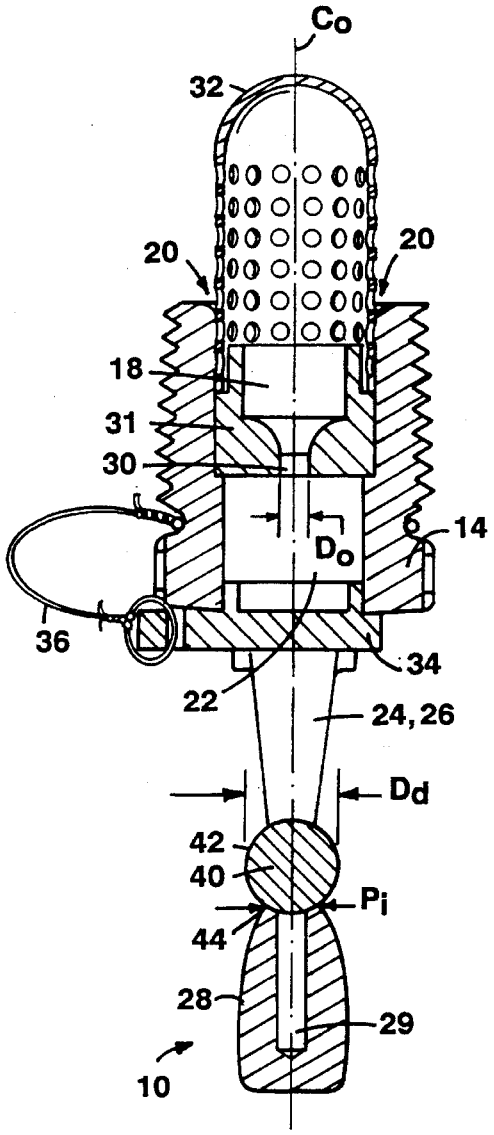
FIG. 2 is a side elevation, taken in section, of the fire protection sprinkler nozzle having the spherical diffuser surface of FIG. 1.

Referring also to FIG. 2, the base 14 defines an axial passageway 18 therethrough for flow of fire retardant fluid from the inlet 20 (in communication with the fluid supply system) to the outlet 22, exterior of the base. In a region downstream of the outlet, arms 24, 26 extend from the base 14 to an apex 28 positioned downstream of and coaxial with the orifice 30, defined by orifice insert 31 positioned within passageway 18 of base 14, e.g. much the same as in traditional nozzles typically used for fire protection system service.

A strainer 32 is positioned across the inlet 20 to passageway 18 in manner to protect orifice 30 in orifice insert 31 from clogging, e.g., due to debris in the fluid supply system. Under standby conditions (FIG. 2), an elastomeric plug 34 seals the outlet 22 to passageway 18 and the orifice 30 from airborne debris or insects that might tend to clog the orifice. Wire 36 attaches the plug 34 to the base 14 of the nozzle so that the plug will not be blown away from the nozzle upon discharge of fluid from the nozzle.

In principle, the device so far described operates in much the same manner as many of the nozzles used in fire protection system service today.

Referring again to FIG. 2, in the nozzle 10 of the invention, a spherical diffuser element 40 is positioned coaxially with the centerline, $C_o$, of the orifice 30, with the diffuser element 40 partially recessed within and centered by axial bore 29 defined in apex 28, and secured, e.g., by resistance welding, at the upstream end of apex 28 of the support arms 24, 26.

In a preferred embodiment of the invention, the nominal diameter, $D_o$, of the orifice 30 is 0.091 inch; the diffuser element 40 has an outer surface 42 in the shape of a sphere, with a nominal diameter, $D_d$, of 0.281 inch at its equatorial plane; the diameter, $D_s$, at the intersection of the spherical outer surface 42 of the diffuser element 40, and apex 28, partially recessed within and centered by hole 29, with a horizontal plane, $P_i$, extending through the upper edge 44 of the apex 28, is nominally 0.18 inch; and the nominal diameter, $D_p$, of the perforations 46 in the strainer 32 are 0.060 inch. The upstream (inside) edges 48, 50 of the arms 24, 26 in the vicinity of the apex 28 are nominally 0.03 inch thick, gradually increasing to a nominal thickness of 0.10 inch at their downstream (outside) edges 49, 51.

Figure 3:
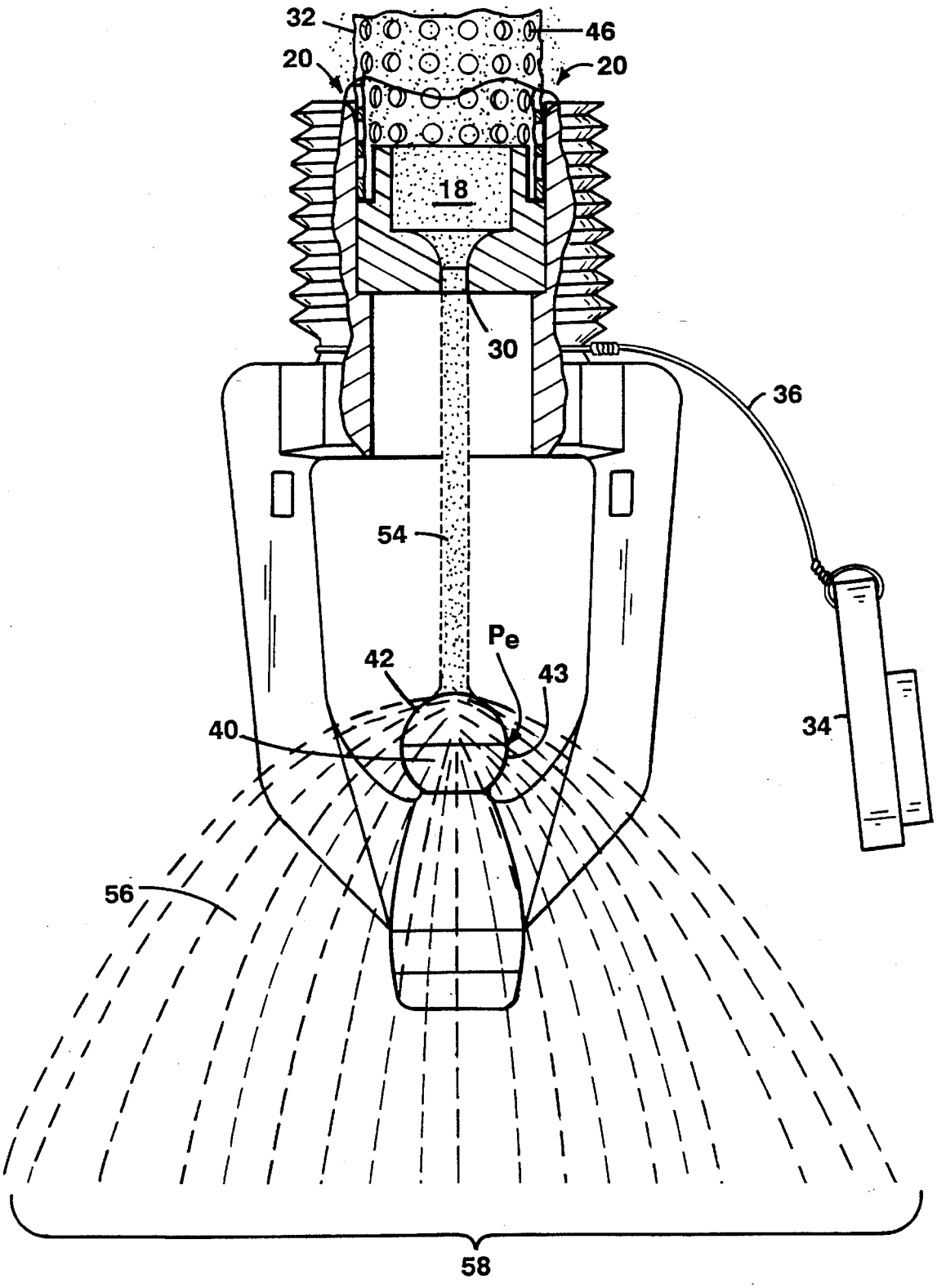
FIGS. 3 and 4 are somewhat diagrammatic, enlarged front and sides view, respectively, both taken in section, showing fluid flowing from the orifice onto the diffuser element surface to be diffused into a generally conical spray pattern that is nearly completely filled with fine fluid droplets.
Figure 4:
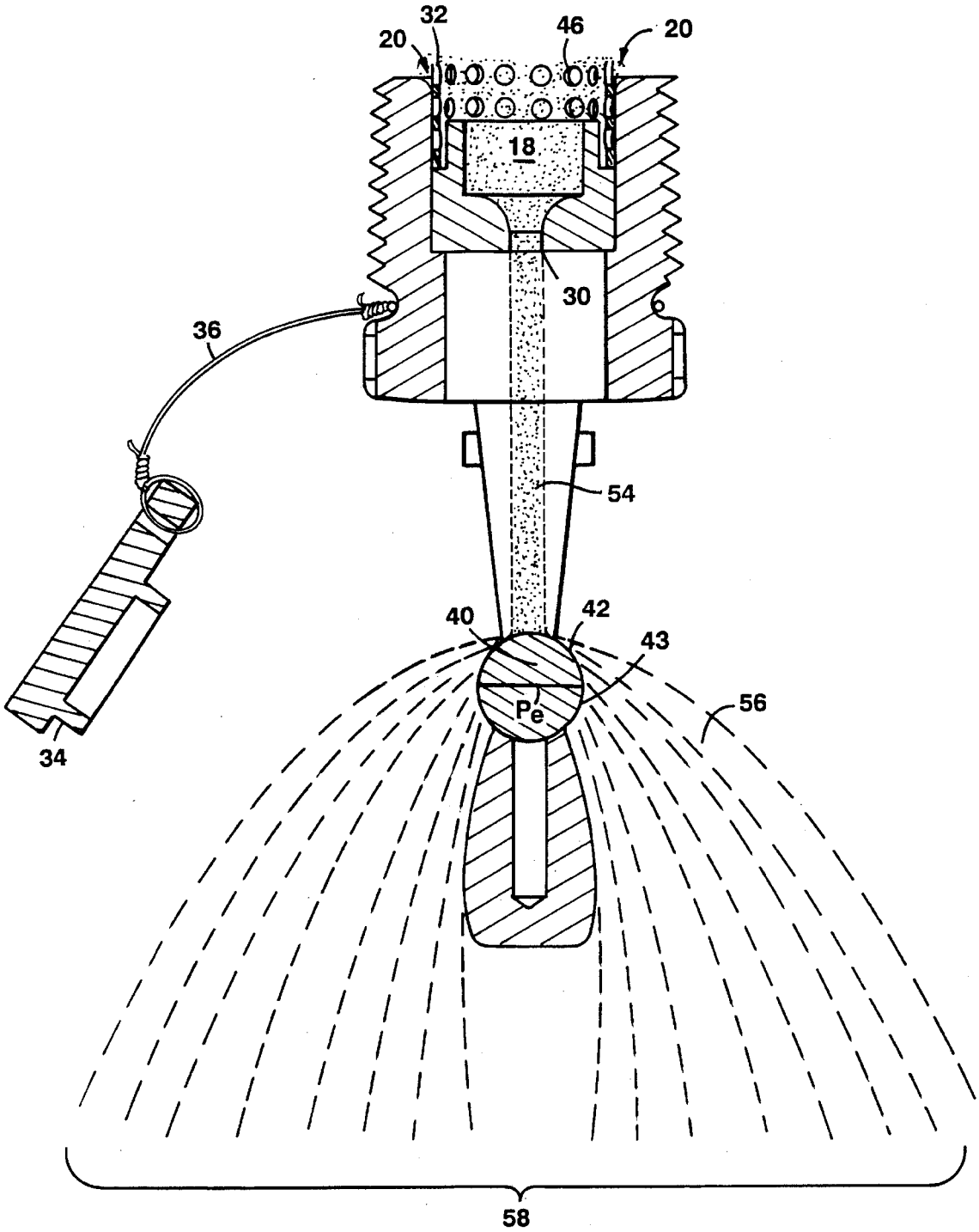

Referring now to FIGS. 3 and 4, upon actuation, fire retardant fluid is caused to flow from the fire retardant fluid supply system (not shown), through perforations 46 in strainer 32, into passageway 18 via inlet 20 and through orifice 30. The pressure of fluid flow from the orifice dislodges the plug 34 (secured by wire 36) from the outlet 22, allowing the fluid 54 to impinge upon the spherical diffuser surface 42 of the spherical diffuser element 40. As represented in the drawings, fine droplets 56 become detached from all around the spherical surface 42 of the diffuser, element 40, including that portion 43 of the spherical surface 42 which is downstream of its equatorial plane, $P_e$, which results in a generally conical spray pattern 58 that is nearly completely filled with fine fluid droplets.

Other embodiments of the invention are within the scope of the following claims. For example, a spherical diffuser element of the invention may be part of a nozzle with an orifice that discharges a coherent fluid stream, to minimize splashing upon impingement of the stream against the spherical diffuser surface, as well as to maintain a spray pattern with an envelope that varies relatively little in outside dimension over the pressure range of from 100 to 300 psi.

A hand held nozzle of the invention for spraying mist onto a fire by trained fire service personnel may define an orifice 30 substantially larger in diameter, e.g. 1.00 inch or more.

Also, the diffuser surface of a diffuser element in a nozzle of the invention may have a diameter four or more times the diameter of the orifice, if diameter $D_p$ (FIG. 1) is made sufficiently small and some lightening of the concentration of the droplets can be tolerated in the zone coaxial with and downstream of the nozzle.

The apex 28 at the juncture of frame arms 24, 26 may have a shape defining a spherical diffuser surface, thus eliminating the need for a separate diffuser element and further eliminating the operation of securing a separate diffuser element to the apex.

The diffuser element 40 may define another, smoothly changing, but more complicated shape, e.g., a spheroid, to accomplish objectives of the invention in manner similar to that achieved by the preferred embodiment of the invention described above, but distributing the spray in a different, preferential pattern over the area to be protected.

The spherical or other diffuser element of the invention may be located downstream of the one or more support arms, provided that the arms are sufficiently streamlined to minimize disturbance to the fluid stream impinging on the diffuser element surface. The spherical diffuser element may also be connected, e.g., to a cylindrical stem which, in turn, is attached to the apex of the nozzle support arms, or to the nozzle base, to position the diffuser element in a preferred position.

The spherical diffuser element of the invention may be utilized as part of an automatically operating nozzle, with a temperature sensitive release element, means for adjusting the axle position of the diffuser element diffuser surface, means for securing the temperature sensitive release element, and/or an orifice seal in a normal or standby condition.

What is claimed is:

1. A fire protection nozzle comprising a base defining an orifice having a diameter through which fire-retardant fluid can flow, an inlet section having an upstream end and defining a conduit for flow of fire-retardant fluid along a conduit axis and leading to an upstream end of said orifice, a diffuser element positioned coaxially with and downstream of said orifice, said diffuser element defining a diffuser surface that is generally spherical in shape in a region extending from an upstream end closest to said orifice to at least downstream of an equatorial plane of said diffuser element transverse to said conduit axis, said diffuser surface having a diameter that is at least two times the diameter of said orifice, and one or more arms extending from said base for fixedly supporting said diffuser element in position, wherein when a flow of fire-retardant fluid from said inlet section through said orifice is established, fire-retardant fluid emerges from said orifice in a stream which impinges on said diffuser surface and is thereby distributed in a spray pattern over an area to be protected.

2. The fire protection nozzle of claim 1 wherein the diameter of said diffuser surface is between two times and four times the diameter of said orifice.

3. The fire protection nozzle of claim 1 wherein said diameter of said diffuser surface is approximately three times the diameter of said orifice.

4. The fire protection nozzle of claim 1 wherein the diameter of said diffuser surface is between about 0.18 inch and 0.38 inch.

5. The fire protection nozzle of claim 1 wherein the diameter of said diffuser surface is about 0.28 inch.

6. The fire protection nozzle of claim 1, 2, 3, 4, or 5 wherein the diameter of said diffuser surface occurs at the equatorial plane of said diffuser element.

7. The fire protection nozzle of claim 1 wherein the diameter of said orifice is between about 0.06 inch and 0.12 inch.

8. The fire protection nozzle of claim 1 wherein the diameter of said orifice is about 0.09 inch.

9. The fire protection nozzle of claim 1 wherein, when fire retardant fluid flows from said orifice at a pressure of 100 psi or more, as measured at the upstream end of said inlet section, fire-retardant fluid emerges from said orifice in a stream which impinges on said diffuser surface and is thereby distributed in a substantially filled cone of spray pattern over an area to be protected.

10. The fire protection nozzle of claim 1 wherein, when fire-retardant fluid flows from said orifice at a pressure of 170 psi or more, as measured at the upstream end of said inlet section, fire-retardant fluid emerges from said orifice in a stream which impinges on said diffuser surface and is thereby distributed in a substantially filled cone of spray pattern over an area to be protected.

11. A fire protection nozzle comprising a base defining an orifice having a diameter through which fire-retardant fluid can flow, an inlet section having an upstream end and defining a conduit for flow of fire-retardant fluid along a conduit axis and leading to an upstream end of said orifice, a diffuser element positioned coaxially with and downstream of said orifice, said diffuser element defining a diffuser surface that is generally spherical in shape in a region extending from an upstream end closest to said orifice to at least downstream of an equatorial plane of said diffuser element transverse to said conduit axis, said diffuser surface having a characteristic diameter in the equatorial plane, two arms extending from said base for fixedly supporting said diffuser element in position, and an apex element disposed at a juncture of said arms, generally coaxial with said conduit axis, said diffuser element being fixedly mounted at an end of said apex closest to said orifice, with an area of intersection of said diffuser element and said apex, in a plane perpendicular to said conduit axis, having a diameter that is about 65 percent or less of the diameter of said diffuser surface in the equatorial plane, wherein when fire-retardant fluid flows through said orifice, fire-retardant fluid emerges from said orifice in a stream which impinges on said diffuser surface, whereby a portion of the fire retardant fluid impinging on said diffuser surface remains on said diffuser surface downstream, past said equatorial plane.

12. The fire protection nozzle of claim 11 wherein said diffuser element is fixedly secured to said apex by resistance welding.

13. The fire protection nozzle of claim 11 wherein said diffuser surface has a diameter that is at least two times the diameter of said orifice.

* * * * *